US011464272B2

(12) United States Patent
Melofchik et al.

(10) Patent No.: US 11,464,272 B2
(45) Date of Patent: Oct. 11, 2022

(54) ATTACHMENT FEATURES FOR BATTING HELMETS

(71) Applicant: EASTON DIAMOND SPORTS, LLC, Thousand Oaks, CA (US)

(72) Inventors: Ryan Melofchik, Sherman Oaks, CA (US); Tazo Osawa, West Hills, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 309 days.

(21) Appl. No.: 16/841,499

(22) Filed: Apr. 6, 2020

(65) Prior Publication Data

US 2021/0307447 A1 Oct. 7, 2021

(51) Int. Cl.
*A42B 3/20* (2006.01)

(52) U.S. Cl.
CPC ..... *A42B 3/20* (2013.01)

(58) Field of Classification Search
CPC .. A42B 3/08; A42B 3/20; A42B 3/205; A42B 3/12
See application file for complete search history.

(56) References Cited

U.S. PATENT DOCUMENTS

| | | | | |
|---|---|---|---|---|
| 6,708,339 | B1 | 3/2004 | Smith | |
| D492,818 | S | 7/2004 | Ide et al. | |
| 7,900,279 | B2 | 3/2011 | Kraemer et al. | |
| 8,296,868 | B2 | 10/2012 | Belanger et al. | |
| 9,345,282 | B2 | 5/2016 | Durocher et al. | |
| 9,511,272 | B2 | 12/2016 | Lowe et al. | |
| 9,750,298 | B2 | 9/2017 | Summerville | |
| 10,219,579 | B2 | 3/2019 | Gotti | |
| 10,426,215 | B2 | 10/2019 | Morin et al. | |
| 2004/0025231 | A1* | 2/2004 | Ide | A42B 3/20 2/424 |
| 2007/0250992 | A1* | 11/2007 | Brown | A42B 3/20 2/424 |
| 2010/0251464 | A1* | 10/2010 | Parisi | A42B 3/20 2/9 |

(Continued)

FOREIGN PATENT DOCUMENTS

| | | | | |
|---|---|---|---|---|
| GB | 2013770 A | * | 8/1979 | A42B 3/08 |

OTHER PUBLICATIONS

Easton, Prowess Helmet Chin Strap Instructions, content publicly available before 2019.

*Primary Examiner* — Tajash D Patel
(74) *Attorney, Agent, or Firm* — Perkins Coie LLP

(57) ABSTRACT

A batting helmet system includes sockets facing the interior region of the helmet shell to receive clip elements for holding a chin strap or to receive plate elements for supporting a face protector. A clip element includes a base portion, a hook portion extending from the base portion, and a projection positioned on an end of the hook portion and extending toward the base portion. The base portion may include a strap retainer. When the clip element is installed, the clip element extends from the interior of the helmet to the exterior of the helmet through an opening in the helmet shell, so that the strap retainer is positioned outside the helmet shell. A face protector may include plate elements for positioning in one or more of the sockets. Plate elements and sockets may have corresponding geometries that limit rotation of the face protector relative to the helmet shell.

15 Claims, 6 Drawing Sheets

(56) References Cited

U.S. PATENT DOCUMENTS

| | | | | |
|---|---|---|---|---|
| 2013/0067643 | A1 | 3/2013 | Musal et al. | |
| 2013/0067645 | A1 | 3/2013 | Musal et al. | |
| 2013/0219595 | A1 | 8/2013 | Musal | |
| 2017/0291096 | A1 | 10/2017 | Melofchik et al. | |
| 2017/0311669 | A1* | 11/2017 | Morin | A42B 3/324 |
| 2019/0313725 | A1* | 10/2019 | Princip | A42B 3/067 |
| 2020/0061890 | A1 | 2/2020 | Rusakov et al. | |

* cited by examiner

ATTACHMENT FEATURES FOR BATTING HELMETS

BACKGROUND

Many batting helmets include attachment features for a chin strap and a face protector. Some players use only a chin strap, others use only a face protector, and others use both a chin strap and a face protector. Some players use neither a chin strap nor a face protector.

Typical batting helmets include male snap elements mounted to the helmet shell to receive female snap elements on a chin strap, so that the chin strap may be snapped onto the batting helmet. This conventional snap-connection requires several components (such as the snaps and hardware to hold the snaps to the helmet) that add to the weight, cost, and manufacturing complexity of the helmet. The male snap elements are also somewhat unsightly, especially when a chin strap is not attached to the helmet.

A typical face protector is fastened to the exterior of a batting helmet using four to six bolts. Such a conventional connection adds to the weight, cost, and manufacturing complexity of the helmet. It also complicates installation and removal of the face protector. When a player chooses not to use such a face protector, several holes are exposed on the exterior of the helmet shell.

SUMMARY

A batting helmet system includes sockets in the interior of the helmet shell. Some sockets may be configured to receive clip elements for holding a chin strap. Other sockets may be configured to receive plate elements for supporting a face protector. In some embodiments, a batting helmet system may include sockets for receiving clip elements but not sockets for receiving plate elements, and vice versa.

A clip element may include a base portion, a hook portion extending from the base portion, and a projection extending from the hook portion (such as a generally cylindrical projection extending from an end of the hook portion toward the base portion). The base portion may include a strap retainer. The clip element may engage a socket, and the clip element may extend from the interior of the helmet to the exterior of the helmet through an opening in the helmet shell, so that the strap retainer is positioned outside the helmet shell.

A face protector may include plate elements that are positioned or positionable in one or more of the sockets. The plate elements and the sockets may have corresponding geometries that limit rotation of the face protector relative to the helmet shell.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to attachment features for batting helmets, such as chin-strap clips and face-protector attachment systems, and associated systems and methods. Various embodiments of the technology will now be described. The following description provides specific details for a thorough understanding and enabling description of these embodiments. One skilled in the art will understand, however, that the technology may be practiced without many of these details. Additionally, some well-known structures or functions, such as structures or functions common to helmets, may not be shown or described in detail to avoid unnecessarily obscuring the relevant description of the various embodiments. Accordingly, embodiments of the present technology may include additional elements or exclude some of the elements described below with reference to FIGS. 1-6, which illustrate examples of the technology.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Specific details of several embodiments of the present technology are described herein with reference to batting helmets. Embodiments of the present technology may be implemented in other helmets, such as hockey helmets, football helmets, bicycle helmets, motorcycle helmets, or other helmets. Embodiments of the present technology may also be implemented in other protective gear such as masks or other headwear for sports or other activities.

Helmet Shell

Figure 1:
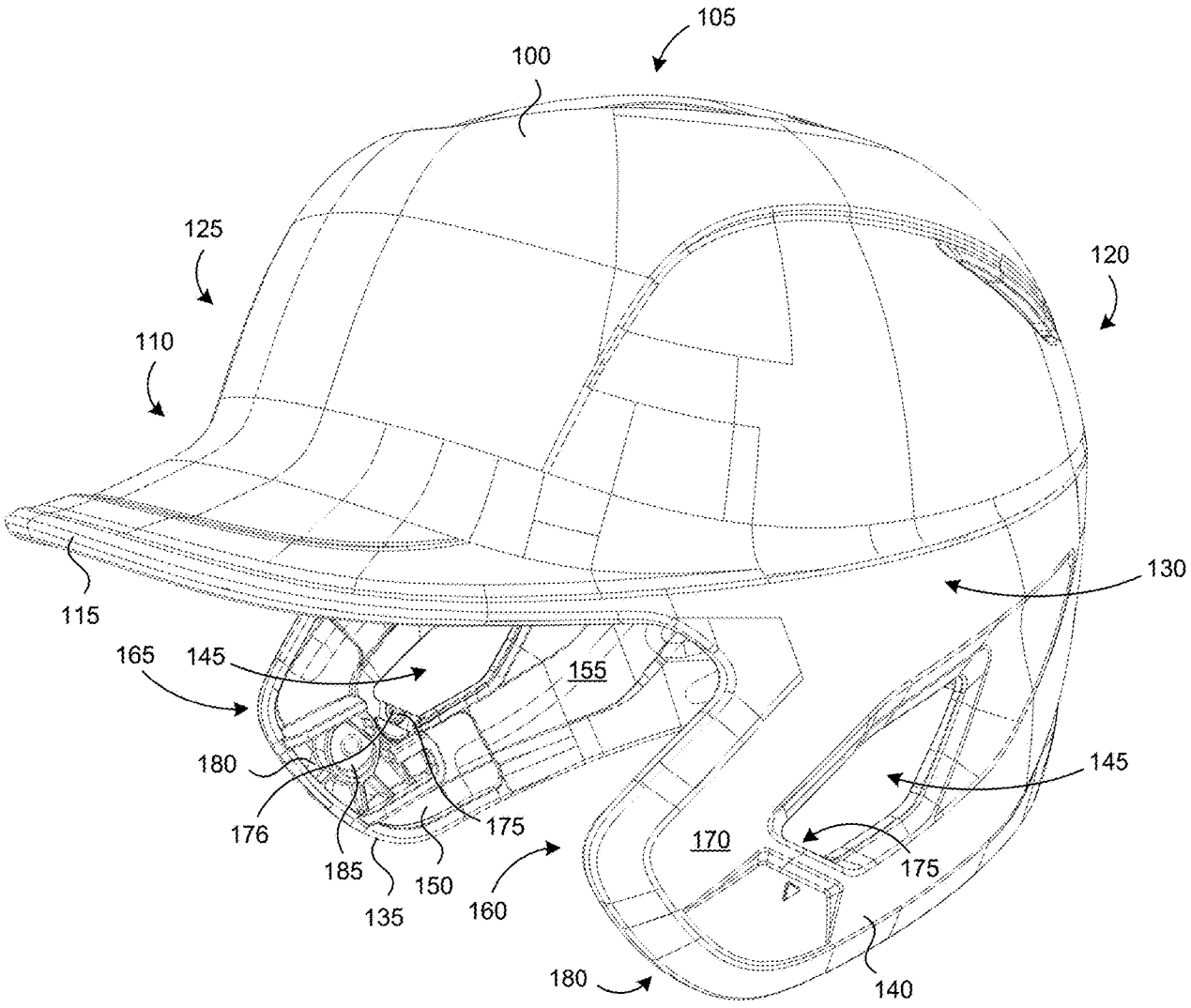
FIG. 1 illustrates a perspective view of a helmet shell configured in accordance with embodiments of the present technology.

Turning now to the drawings, FIG. 1 illustrates a perspective view of a helmet shell 100 configured in accordance with embodiments of the present technology. The helmet shell 100 (which may be referenced as a "shell" herein) includes a crown region 105 positioned to cover the top of a user's head, a front (forehead) region 110 (which may optionally include a visor 115) positioned to cover an anterior portion of a user's head, a rear region 120 positioned to cover a posterior portion of a user's head, a first side region 125 positioned to cover a lateral portion of a user's head, and a second side region 130 positioned opposite the first side region 125 to cover another lateral portion of a user's head. The first side region 125 may include a first lateral flap 135 and the second side region 130 may include a second lateral flap 140. Each of the side regions 125, 130 includes an opening 145, which may optionally form a vent hole for sound or air to reach a user's ear from outside the shell 100. Each opening 145 may be positioned in one of the lateral flaps 135, 140.

The first side region 125 and the first lateral flap 135 include an inner surface 150 facing an interior region 155 of the shell 100. The second side region 130 and the second lateral flap 140 also include an inner surface 160 facing the interior region 155 of the shell 100. The interior region 155 receives the user's head. The first side region 125 and the first lateral flap 135 further include an outer surface 165 facing away from the shell 100. Likewise, the second side region 130 and the second lateral flap 140 include an outer surface 170 facing away from the shell 100.

The inner surfaces 150, 160 of the lateral flaps 135, 140 may include sockets for receiving clip elements or portions of a face protector, as described in additional detail below. Specifically, the inner surfaces 150, 160 of the lateral flaps 135, 140 may include first sockets 175 positioned to receive clip elements for holding a chin strap. Only one such first socket 175 is visible in FIG. 1, on the first lateral flap 135. The other first socket 175 may be similar and may be symmetrically positioned and oriented on the second lateral flap 140. The inner surfaces 150, 160 of the lateral flaps 135, 140 may additionally or alternatively include second sockets 180 positioned to receive plate elements of a face protector. Only one such second socket 180 is visible in FIG. 1, on the first lateral flap 135. The other second socket 180 may be similar and may be symmetrically positioned and oriented on the second lateral flap 140. Helmet shells configured in accordance with some embodiments of the present technology may not include a first lateral flap 135 or a second lateral flap 140, or they may not include any lateral flaps 135, 140. In such embodiments, other areas of the inner surfaces 150, 160 of the side regions 125, 130 may include the sockets 175, 180 (for example, the sockets 175, 180 may be positioned closer to the crown region 105).

Each of the sockets 175, 180 may be formed as a recess in the shell 100 extending away from the interior region 155 of the shell 100. For example, the helmet shell 100 may be molded to include these recesses. In some embodiments, the recesses may be formed by projecting or extruding bordering material inwardly from the helmet shell 100 toward the interior region 155. For example, a wall or boundary of material may define the recesses forming the sockets 175, 180. In further embodiments, one or more of the recesses may be included in a discrete element affixed to the helmet shell 100. In some embodiments, the first sockets 175 can include a rounded or circular shape configured to correspond to a portion of a clip element, as described in additional detail below. In some embodiments, the second sockets 180 may have a non-circular shape to limit (for example, prevent or at least substantially prevent) rotation of the plate elements of a face protector relative to the shell 100, as described in additional detail below. For example, in some embodiments, the second sockets 180 may have a polygonal shape, such as a rectangular shape, a triangular shape, or another shape suitable for limiting rotation of the plate elements of a face protector relative to the shell 100. In some embodiments, each of the second sockets 180 may include a cavity 185 for receiving a boss on the plate elements, as described in additional detail below.

In general, the shell 100 may be configured to cover most or all of a player's head, with the exception of the player's face, which may generally be exposed or partially covered with a face protector or a chin strap. The helmet shell 100 facilitates attaching a face protector or a chin strap to the helmet shell 100 using features (such as the sockets 175, 180) that are generally concealed within the interior region 155 of the shell 100. Accordingly, when a face protector or a chin strap is not used, the helmet shell 100 has a cleaner exterior appearance with less weight than conventional helmets.

Chin-Strap Clips

Figure 2A:
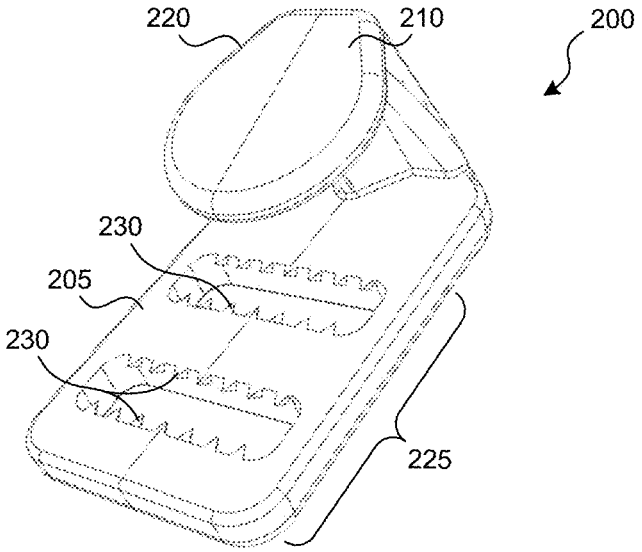
FIGS. 2A, 2B, and 2C illustrate a first perspective view, a second perspective view, and a side perspective view, respectively, of a clip element configured in accordance with embodiments of the present technology.
Figure 2B:
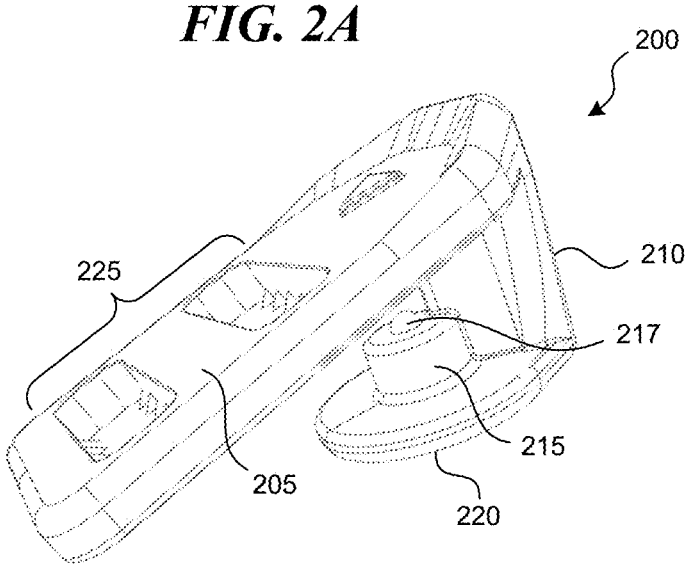
Figure 2C:
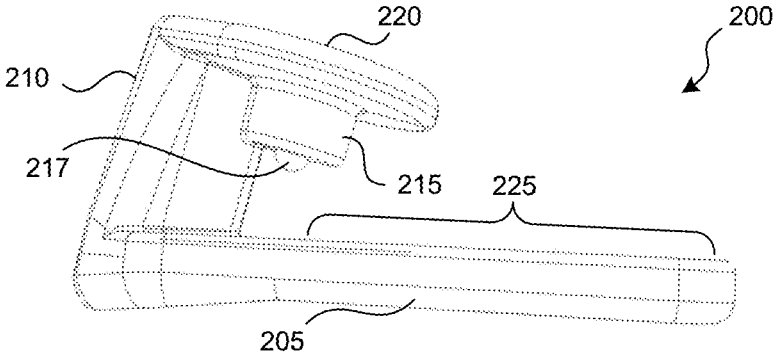

FIGS. 2A, 2B, and 2C illustrate a first perspective view, a second perspective view, and a side perspective view, respectively, of a clip element 200 configured in accordance with embodiments of the present technology. The clip element 200 is configured to engage either one of the side regions 125, 130 (see above regarding FIG. 1). For example, a clip element 200 may engage the first socket 175 in the first lateral flap 135 or the first socket 175 in the second lateral flap 140. The clip element 200 is also configured to retain a portion of a chin strap, as explained in additional detail below.

In some embodiments, the clip element 200 includes a base portion 205, a hook portion 210 extending from the base portion 205, and an engagement element 215 on the hook portion 210. In some embodiments, the engagement element 215 may be a projection positioned on an end 220 of the hook portion 210. The engagement element 215 may extend from the end 220 of the hook portion 210 toward the base portion 205. The engagement element 215 may have a generally cylindrical shape corresponding to a generally cylindrical shape of a portion of one of the first sockets 175. In some embodiments, the engagement element 215 and the corresponding first socket 175 may have other corresponding shapes. In some embodiments, the engagement element 215 may include a surface feature 217 (such as a hemispherical surface feature) configured to engage a corresponding indentation in the first socket 175 (for example, an indentation 176, see FIG. 1).

The base portion 205 includes a strap retainer 225. The strap retainer 225 is configured to hold a portion of a chin strap. In some embodiments, the strap retainer 225 is a strap adjuster such as a ladder-lock buckle (visible in FIGS. 2A and 2B, sometimes called a ladder adjuster), a D-ring, an adjustable clamp device, or another device suitable for adjustably retaining a portion of a chin strap. In some embodiments, the strap retainer 225 is a strap adjuster with one or more teeth 230 or similar elements for gripping the portion of the chin strap.

Figure 3:
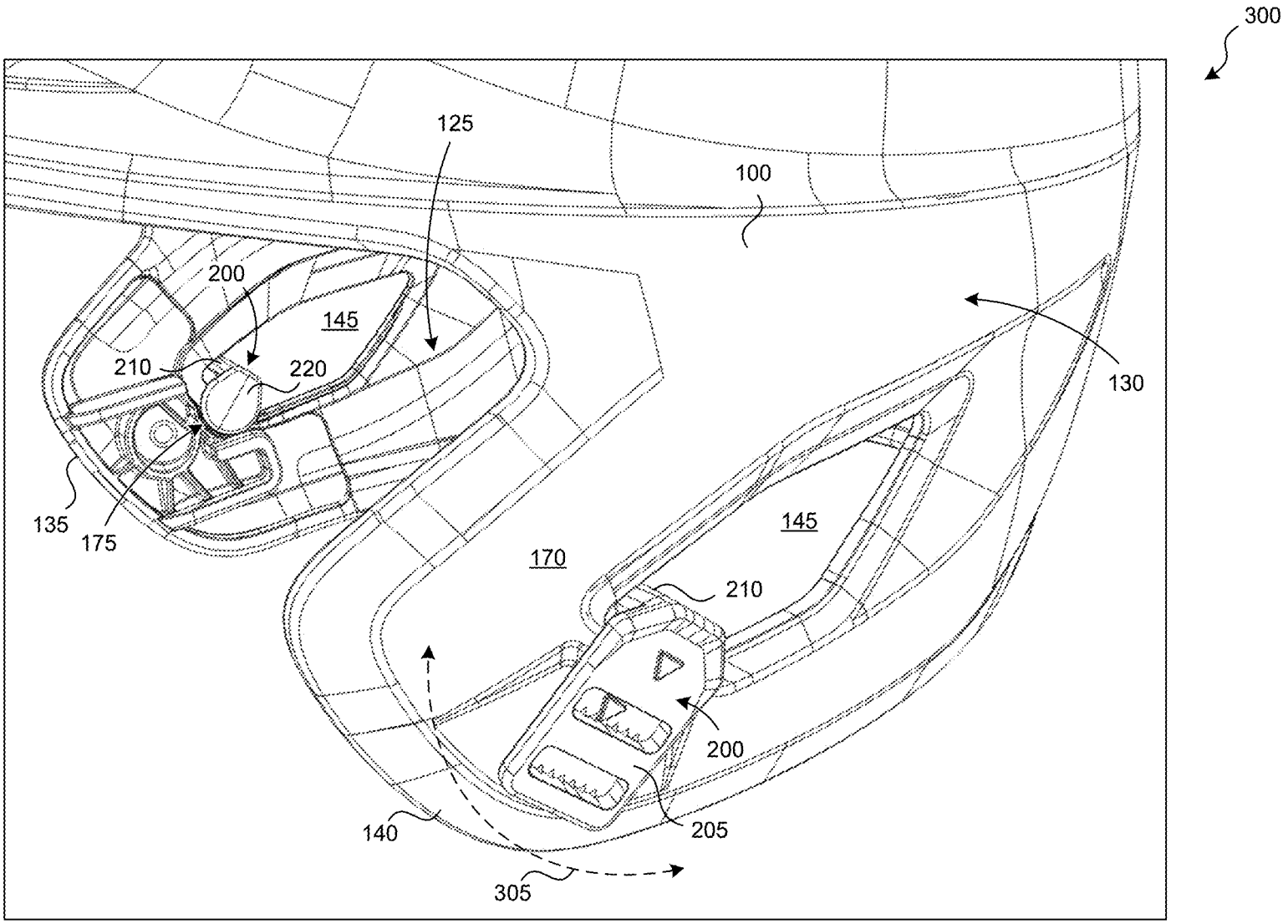
FIG. 3 illustrates a portion of a batting helmet system configured in accordance with embodiments of the present technology, in which clip elements are attached to the helmet shell.

FIG. 3 illustrates a portion of a batting helmet system 300 configured in accordance with embodiments of the present technology. Two clip elements 200 are attached to the shell 100 (one on each side region 125, 130). Each engagement element 215 (see FIGS. 2A, 2B, 2C) is engaged with a side region 125, 130 (for example, positioned in a first socket 175). Each hook portion 210 extends through an ear vent or other opening 145 in a respective side region 125, 130 of the shell 100. The base portion 205 of the clip element 200 is positioned outside of the shell 100, where it can receive and adjustably retain a portion of a chin strap.

In some embodiments, each clip element 200 is installed in the batting helmet system 300 by snapping the engagement element 215 into a socket 175 in a side region 125, 130 (for example, in a lateral flap 135, 140). Such snapping is facilitated by the relative shape and sizes of the engagement element 215 and the socket 175. For example, in some embodiments, the rounded shape of the engagement element 215 must be forced (snapped) into the socket 175. In some embodiments, each clip element 200 may be rotated about the engagement element 215 along a rotational path 305 that sweeps across the outer surface 170 to facilitate positioning of the base portion 205 (and therefore, a chin strap, such as the chin strap 605 described below) according to a user's preferences (for example, according to a user's preferred position of a chin strap). In some embodiments, the rotational path 305 includes rotation of approximately fifteen degrees relative to the shell 100. In some embodiments, rotating the clip element 200 upwards (toward the crown region) beyond the extent of the rotational path 305 facilitates disengagement and removal (unclipping) of the clip element 200 from the helmet shell 100. A user may install and remove (clip and unclip) the clip elements 200 from the shell 100 while wearing the helmet system 300 or while not wearing the helmet system 300.

The first sockets 175 are only some examples of interior features for receiving the engagement element 215, which may be another device or feature on the end 220 of the hook portion 210 suitable for engaging a corresponding interior feature in the interior region 155 (such as on one of the inner surfaces 150, 160 of the side regions 125, 130). The side regions 125, 130 and the clip elements 200 may include any suitable corresponding features (such as first sockets 175 and engagement elements 215) that facilitate holding the end 220 of the hook portion 210 inside the helmet shell 100 while the base portion 205 is positioned outside the helmet shell 100.

Face Protectors

Figure 4:
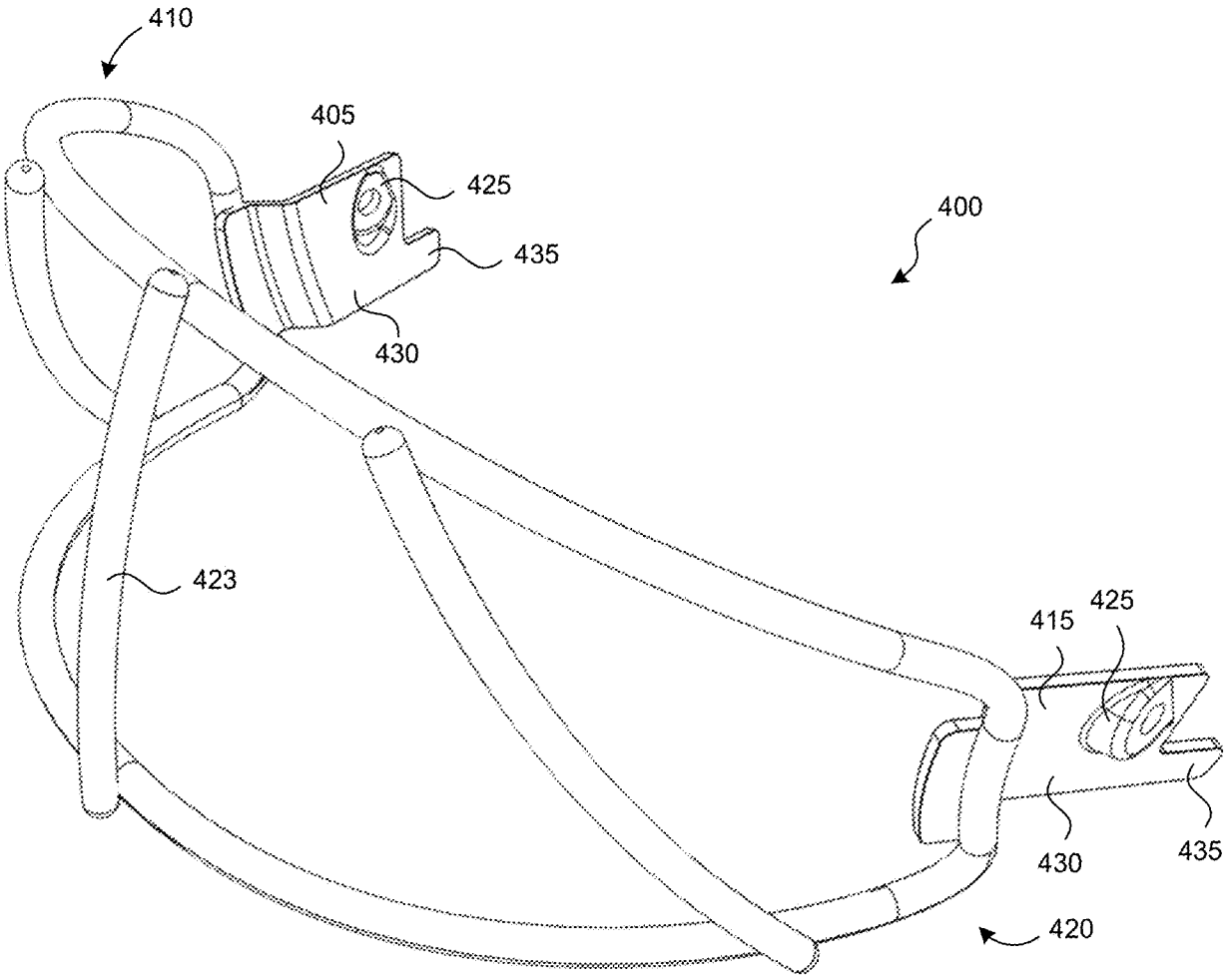
FIG. 4 illustrates a perspective view of a face protector configured in accordance with embodiments of the present technology.

FIG. 4 illustrates a perspective view of a face protector 400 configured in accordance with embodiments of the present technology. The face protector 400 illustrated in FIG. 4 is in the form of a mask (specifically, a wire mask or wire guard), but additional embodiments of the present technology may include other face protectors suitable for use in baseball or other activities to protect a user's face from impact with a ball or another object. The face protector 400 may include a first plate element 405 positioned on a first side 410 of the face protector 400 and a second plate element 415 positioned on a second side 420 of the face protector 400. Each plate element 405, 415 may be a discrete component attached to an anterior portion 423 of the face protector 400 (the anterior portion 423 may include a wire structure as shown, or another structure suitable for protecting a user's face). In some embodiments, the plate elements 405, 415 may be integral components of the face protector 400. The plate elements 405, 415 are positionable in corresponding second sockets 180 (see FIG. 1). In some embodiments, a boss 425 projects outwardly from one or both of the plate elements 405, 415. The boss 425 may be positioned to extend into a corresponding cavity 185 in a socket 180 (see FIG. 1).

Figure 5:
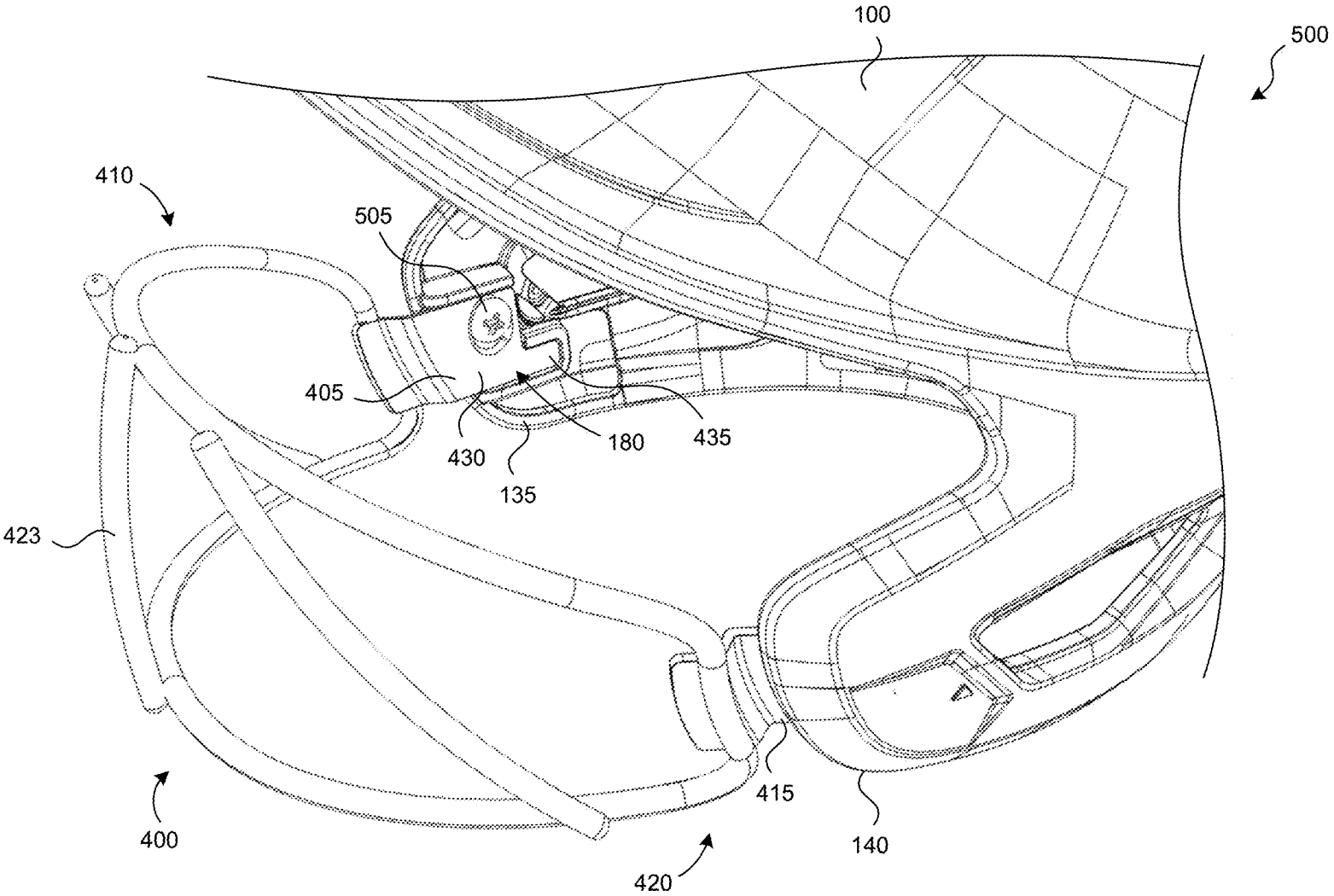
FIG. 5 illustrates a perspective view of a portion of a batting helmet system configured in accordance with embodiments of the present technology, in which a face protector is attached to the helmet shell.

FIG. 5 illustrates a perspective view of a portion of a batting helmet system 500 configured in accordance with embodiments of the present technology. The batting helmet system 500 may include the face protector 400. The plate elements 405, 415 may be positioned in the second sockets 180 in a manner that limits (for example, prevents or at least substantially prevents) rotation of the face protector 400 relative to the shell 100. For example, one or both of the plate elements 405, 415, or one or both of the second sockets 180 (see also, FIG. 1), may be shaped to limit (for example, prevent) rotation of the plate elements 405, 415 relative to the shell 100 when the plate elements 405, 415 are positioned in the second sockets 180. In some embodiments, the plate elements 405, 415 may have shapes that are keyed to the corresponding shapes of the second sockets 180 in a manner that limits rotation of the face protector 400 relative to the shell 100.

Positioning a plate element 405, 415 in the second socket 180 holds the face protector 400 in the shell 100 while limiting (for example, preventing) rotation of the face protector 400 relative to the shell 100, which improves safety during impacts against the face protector 400. In some embodiments, the plate elements 405, 415 and the second sockets 180 may include non-circular shapes, such as corresponding polygonal shapes. With reference to both FIGS. 4 and 5, in particular embodiments, one or both plate elements 405, 415 may each include a first rectangular portion 430 (which itself may include the boss 425) adjacent to the anterior portion 423, and a second rectangular portion 435 projecting from (cantilevered from) the first rectangular portion 430 (for example, projecting in a generally posterior direction). Accordingly, one or both of the plate elements 405, 415 may have an L-shape as generally illustrated in FIGS. 4 and 5. The second sockets 180 may have corresponding shapes (such as a first rectangular portion and a second rectangular portion extending therefrom) to receive the plate elements 405, 415. The single second rectangular portion 435 cantilevered from each plate element 405, 415 provides resistance against forces leveraged upon the anterior portion 423. Generally, embodiments of the present technology include plate elements 405, 415 and second sockets 180 that have corresponding geometries to limit (for example, prevent) rotation of the face protector 400 relative to the shell 100. Preferably, the plate elements and second sockets are sized to have a relatively tight fit with tight tolerances to further limit relative rotation.

The batting helmet system 500 may include a fastener 505 to attach the plate element 405 to the first lateral flap 135 (or generally to the shell 100, if the shell 100 does not include a lateral flap). With additional reference to FIG. 4, the fastener 505 may pass through the boss 425 to engage the shell 100 (which may optionally include an embedded threaded element for receiving the fastener 505). The batting helmet system 500 may include an additional fastener 505 to attach the other plate element 415 to the shell 100 in a similar manner. In some embodiments, one or both of the fasteners 505 may be a releasable fastener (such as a threaded bolt or screw, or a clip configured to clip to an element in the shell 100) or, in other embodiments, fasteners 505 may be omitted and an adhesive or other attachment device may be used to attach the plate elements 405, 415 to the shell 100.

Accordingly, in some embodiments, the face protector 400 may be affixed to the shell 100 using only two fasteners or other attachment devices, while still limiting rotation relative to the shell 100 as a result of the corresponding shapes of the plates 405, 415 and the second sockets 180. In some embodiments, the fasteners or other attachment devices may contribute to resisting rotation of the face protector 400 (for example, by increasing friction between connected elements).

Batting Helmet Systems with Chin-Strap Clips and Face Protectors

Figure 6:
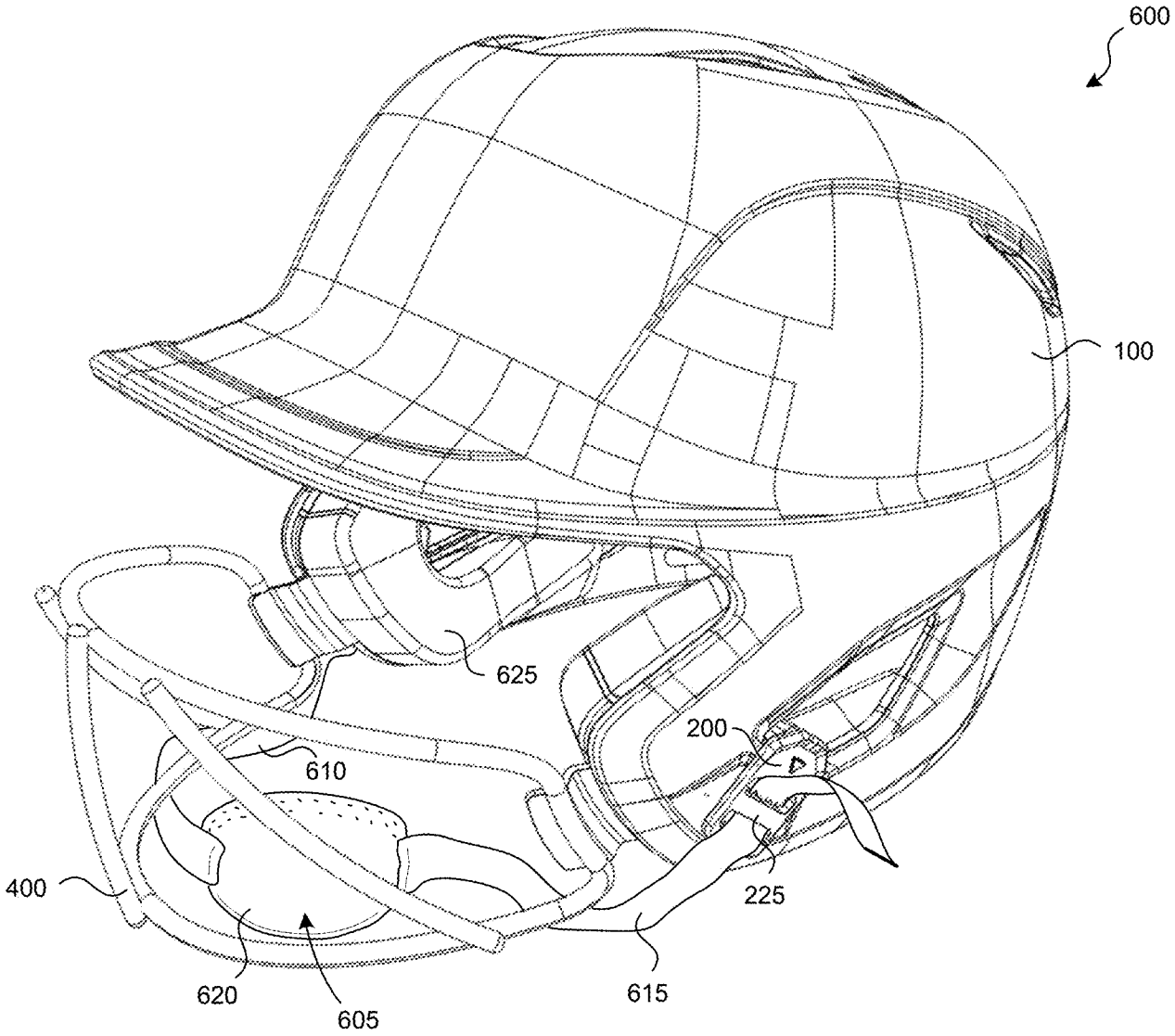
FIG. 6 illustrates a perspective view of a batting helmet system configured in accordance with embodiments of the present technology, in which clip elements and a face protector are attached to the helmet shell. A chin strap is attached to the clip elements.

FIG. 6 illustrates a perspective view of a batting helmet system 600 configured in accordance with embodiments of the present technology. In some embodiments, the batting helmet system 600 may include both a face protector 400 and one or more clip elements 200. The batting helmet system 600 may further include a chin strap 605 retained on the batting helmet system 600 with the strap retainer 225, which may be adjustable to customize tension in the chin strap 605. For example, the chin strap 605 may include a first strap portion 610 held in one of the clip elements 200 (in the strap retainer 225), and a second strap portion 615 held in another one of the clip elements 200. Each end of the chin strap 605 may be held in a strap retainer 225 so that the chin strap 605 spans across a user's face for positioning an optional cup portion 620 of the chin strap 605 on a user's chin.

The shell 100 of batting helmet systems configured in accordance with embodiments of the present technology (such as the batting helmet systems 300, 500, 600 described above) may include a rigid or semi-rigid shell. In some embodiments, batting helmet systems may be partially or fully lined with a shock-absorbing material 625. Those skilled in the art understand suitable shock-absorbing materials 625, which may include foam, gel, fabric, or other various forms of padding, liner(s), or other shock-absorbing material suitable for absorbing impact forces received by the shell 100. Comfort padding, or other comfort-providing material, may also be included inside the shell 100.

Clip elements 200 and helmet systems configured in accordance with embodiments of the present technology facilitate attachment of a chin strap 605 to a helmet shell 100 without the need for additional hardware permanently mounted on the helmet shell 100. Accordingly, embodiments of the present technology facilitate reduction of (a) weight of a batting helmet system, (b) parts of a batting helmet system, or (c) cost of a batting helmet system, while also providing a more aesthetically pleasing appearance when a user does not use a chin strap (a user may remove the clip elements, in contrast with typical helmets that include permanent button snap elements). Clip elements 200 are also easier to operate while a helmet system is on a user's head than traditional connections between chin straps and helmet shells.

Helmet systems and face protectors configured in accordance with embodiments of the present technology provide several other advantages. For example, because the present technology provides a batting helmet system (such as the batting helmet systems 500, 600 described above) that includes a face protector 400 attached to the interior of the shell 100, the exterior of the shell 100 need not include unattractive exterior mounting features for the face protector 400. Embodiments of the present technology use less hardware than typical batting helmets, which reduces weight, cost, and complexity of manufacturing. Embodiments of the present technology limit rotation of the face protector 400 relative to the shell 100, which increases safety.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, although clip elements 200 are described and illustrated as being implemented on both sides of a helmet, in some embodiments, a clip element 200 may be used on one side of a helmet but not the other (the other side of the helmet may use an alternative suitable connection between the chin strap and the helmet). Similarly, a face protector configured in accordance with embodiments of the present technology may exclude one of the plate elements on a side of the face protector, instead connecting to the shell in another manner on that side of the face protector.

In some embodiments, a helmet system may include only a face protector 400 and it may omit clip elements. In some embodiments, a helmet system may omit a face protector and it may include one or more clip elements 200. Accordingly, various combinations of clip elements, plate elements, face protectors, and chin straps are contemplated by the various embodiments of the present technology. For example, some helmets may include only one lateral flap for accommodating aspects of the present technology. Correspondingly, shells configured in accordance with embodiments of the present technology may omit one or more of the sockets for receiving clip elements or plate elements.

Although shells are described as including a crown region, a front region, a rear region, side regions, and lateral flaps, embodiments of the present technology may be implemented in shells that omit one or more of these elements. Embodiments of the present technology need not include a helmet shell. For example, embodiments of the present technology may include clip elements, face protectors and other components as independent devices.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

Numerical adjectives including "first" and "second," as used in the foregoing description, do not convey hierarchy or specific features or functions. Rather, such numerical adjectives are intended to aid the reader in distinguishing between elements which may have similar nomenclature (for example, "sockets" or "side regions"), but which may differ in position, orientation, or structure. Accordingly, such numerical adjectives may be used differently in the claims than in the foregoing description.

What is claimed is:

1. A batting helmet system comprising:

a shell including a crown region, a front region, a rear region, a first side region, and a second side region positioned opposite the first side region, wherein each side region comprises an inner surface facing an interior region of the shell and an outer surface facing away from the shell, and wherein the inner surface of the first side region comprises a socket;

a clip element, wherein the clip element comprises a base portion, a hook portion extending from the base portion, and an engagement element on the hook portion, and wherein the base portion includes a strap retainer; and a face protector, wherein the face protector includes a first plate element positioned on a first side of the face protector; wherein:

the clip element is configured to engage with the first side region, wherein when the clip element is engaged with the first side region, the hook portion extends through an opening in the first side region, and the base portion is positioned outside the shell; and the first plate element is positioned or positionable in the socket, wherein the first plate element and the socket are each shaped to prevent rotation of the first plate element relative to the shell when the first plate element is positioned in the socket.

2. The batting helmet system of claim 1, wherein the first side region includes a first lateral flap and the second side region includes a second lateral flap, wherein the first lateral flap includes the socket.

3. The batting helmet system of claim 1, wherein:

the socket is a first socket and the inner surface of the first side region further comprises a second socket;

the engagement element is a projection extending from the hook portion towards the base portion; and when the clip element is engaged with the first side region, the projection is positioned in the second socket.

4. The batting helmet system of claim 3, wherein the projection snaps into and out of the second socket.

5. The batting helmet system of claim 3, wherein the second socket comprises a generally cylindrical shape and the projection comprises a generally cylindrical shape.

6. The batting helmet system of claim 1, wherein the socket is a first socket, the face protector further comprises a second plate element, and wherein:

the inner surface of the second side region comprises a second socket;

the first plate element is positioned in the first socket and connected to the shell using a first fastener;

the second plate element is positioned in the second socket and connected to the shell using a second fastener; and the first fastener and the second fastener are the only fasteners connecting the face protector to the shell.

7. A batting helmet system comprising:

a shell including a crown region, a front region, a rear region, a first side region, and a second side region positioned opposite the first side region, wherein each side region comprises an inner surface facing an interior region of the shell and an outer surface facing away from the shell, and wherein each inner surface comprises a socket; and two clip elements, wherein each clip element comprises a base portion, a hook portion extending from the base portion, and an engagement element on the hook portion, and wherein the base portion includes a strap retainer; wherein each clip element is configured to engage at least one of the side regions, wherein when one of the clip elements is engaged with the at least one of the side regions, the engagement element is positioned in the socket, the hook portion extends through an opening in the at least one of the side regions, and the base portion is positioned outside of the shell.

8. The batting helmet system of claim 7, wherein the engagement element is a projection extending from the hook portion towards the base portion.

9. The batting helmet system of claim 7, wherein the first side region includes a first lateral flap and the second side region includes a second lateral flap, wherein the first lateral flap includes the socket of the first side region and the second lateral flap includes the socket of the second side region.

10. The batting helmet system of claim 7, further comprising a chin strap having a first strap portion and a second strap portion, wherein each of the first strap portion and the second strap portion is positioned in one of the strap retainers.

11. The batting helmet system of claim 7, wherein the opening is a vent hole for a user's ear.

12. The batting helmet system of claim 7, wherein the strap retainer comprises a ladder-lock buckle.

13. The batting helmet system of claim 7, wherein the engagement element snaps into and out of the socket.

14. The batting helmet system of claim 7, wherein the socket comprises a generally cylindrical shape and the engagement element comprises a generally cylindrical shape.

15. The batting helmet system of claim 7, wherein the socket is integrally molded into the shell.

* * * * *